US008919329B2

(12) United States Patent
Lohr et al.

(10) Patent No.: US 8,919,329 B2
(45) Date of Patent: Dec. 30, 2014

(54) PCV SYSTEM HAVING INTERNAL ROUTING

(75) Inventors: John Carl Lohr, Beverly Hills, MI (US); Chris William Newman, Farmington Hills, MI (US); Todd Jay Brewer, Dearborn, MI (US); Frank Acierno Valencia, Canton, MI (US); Gene Reed Andersen, Trenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 221 days.

(21) Appl. No.: 13/290,788

(22) Filed: Nov. 7, 2011

(65) Prior Publication Data

US 2013/0112159 A1 May 9, 2013

(51) Int. Cl.
*F01M 13/00* (2006.01)

(52) U.S. Cl.
USPC ..... 123/572

(58) Field of Classification Search
USPC ..... 123/572–574, 41.86, 306
IPC ..... F01M 13/00,13/02, 13/021, 13/022, F01M 13/045, 2013/0038; F02M 25/06
See application file for complete search history.

(56) References Cited

U.S. PATENT DOCUMENTS

| | | | | |
|---|---|---|---|---|
| 4,517,951 | A * | 5/1985 | Otaka et al. | 123/572 |
| 4,528,969 | A | 7/1985 | Senga | |
| 4,760,833 | A * | 8/1988 | Tatyrek | 123/574 |
| 5,267,543 | A * | 12/1993 | Novak et al. | 123/306 |
| 6,234,154 | B1 | 5/2001 | Spix | |
| 6,659,094 | B2 | 12/2003 | Nakamizo et al. | |
| 7,047,955 | B2 | 5/2006 | Ookawa et al. | |
| 8,511,291 | B2 * | 8/2013 | Hirano et al. | 123/572 |
| 2005/0005921 | A1 | 1/2005 | Ikeda et al. | |
| 2010/0101514 | A1 * | 4/2010 | Hirano et al. | 123/41.86 |
| 2011/0283979 | A1 | 11/2011 | Valencia et al. | |
| 2012/0006306 | A1 * | 1/2012 | Boehm et al. | 123/572 |

FOREIGN PATENT DOCUMENTS

JP 2003301709 A 10/2003

* cited by examiner

*Primary Examiner* — M. McMahon
(74) *Attorney, Agent, or Firm* — Julia Voutyras; Alleman Hall McCoy Russell & Tuttle LLP

(57) ABSTRACT

A positive crankcase ventilation (PCV) system is provided herein. The PCV system includes an engine assembly, the engine assembly including an engine block, a cylinder head, a valve cover, and an intake manifold and a PCV passage providing fluidic communication between a crankcase of the engine assembly and a cylinder intake port of the engine assembly without hoses or conduits external to the engine assembly.

14 Claims, 8 Drawing Sheets

PCV SYSTEM HAVING INTERNAL ROUTING

BACKGROUND/SUMMARY

Gases may form in an engine crankcase when gases from engine cylinders bypass engine pistons and enter the crankcase during engine rotation. These gases are commonly referred to as blow-by gasses. The blow-by gases can be combusted within engine cylinders to reduce engine hydrocarbon emissions via returning the crankcase gases to the engine air intake and combusting the gases with a fresh air-fuel mixture. Combusting crankcase gases via the engine cylinders may require a motive force to move the crankcase gases from the engine crankcase to the engine air intake. One way to provide motive force to move crankcase gases to engine cylinders is to provide pneumatic communication between an engine outlet port receiving engine crankcase gases and a low pressure region (e.g., vacuum) of the engine intake manifold downstream of an engine throttle body. Specifically, external lines or conduits are coupled to the engine outlet port, thereby directing crankcase gases to the engine air intake system. Thus, the gases ventilated from the crankcase are externally routed from the engine crankcase to the engine intake system. In this way, engine vacuum can draw crankcase gases into the engine cylinders for combustion.

However, external routing the positive crankcase ventilation (PCV) lines increases the profile of the engine which may increase vehicle height, thereby reducing vehicle fuel economy. Moreover, it may be possible for externally routed PCV lines to become degraded or removed by a vehicle operator, thereby increasing vehicle emissions.

As such, the inventors herein have recognized the above-mentioned disadvantages and have developed a PCV system. The PCV system includes an engine assembly, the engine assembly including an engine block, a cylinder head, a valve cover, and an intake manifold and a PCV passage providing fluidic communication between a crankcase of the engine assembly and a cylinder intake port of the engine assembly without hoses or conduits external to the engine assembly. By integrating the PCV lines into the cylinder head the compactness of the engine is increased. Furthermore, PCV line degradation may be reduced because the lines are not exposed to the operator or environment.

The present description may provide several advantages. In particular, the approach may provide increased functionality so as to better utilize engine structure via increased PCV oil return passage functionality. In addition, the approach may reduce engine emissions by retaining PCV gases within the engine structure and reducing the possibility of PCV line degradation. Further, the PCV passages may not be as easily removed allowing crankcase gases to escape to ambient surroundings.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description is related to internally routing positive crankcase ventilation (PCV) passages through a cylinder head to intake passages included in the cylinder head. Specifically in one example, a PCV system includes a PCV passage comprised of a plurality of PCV passages providing fluidic communication between a crankcase of the engine assembly and a cylinder intake port of the engine assembly without hoses or conduits external to the engine assembly. Further in some examples, one of the PCV passages may traverse an enclosure whose boundary is partially defined by a cylinder head cover, from an intake side to an exhaust side of the enclosure. Thus, the PCV passage is internally routed. In this way, the compactness of the cylinder head may be increased. Moreover, losses in the PCV system are decreased when the passages are internally routed due to the decreased length of the passages.

Figure 1:
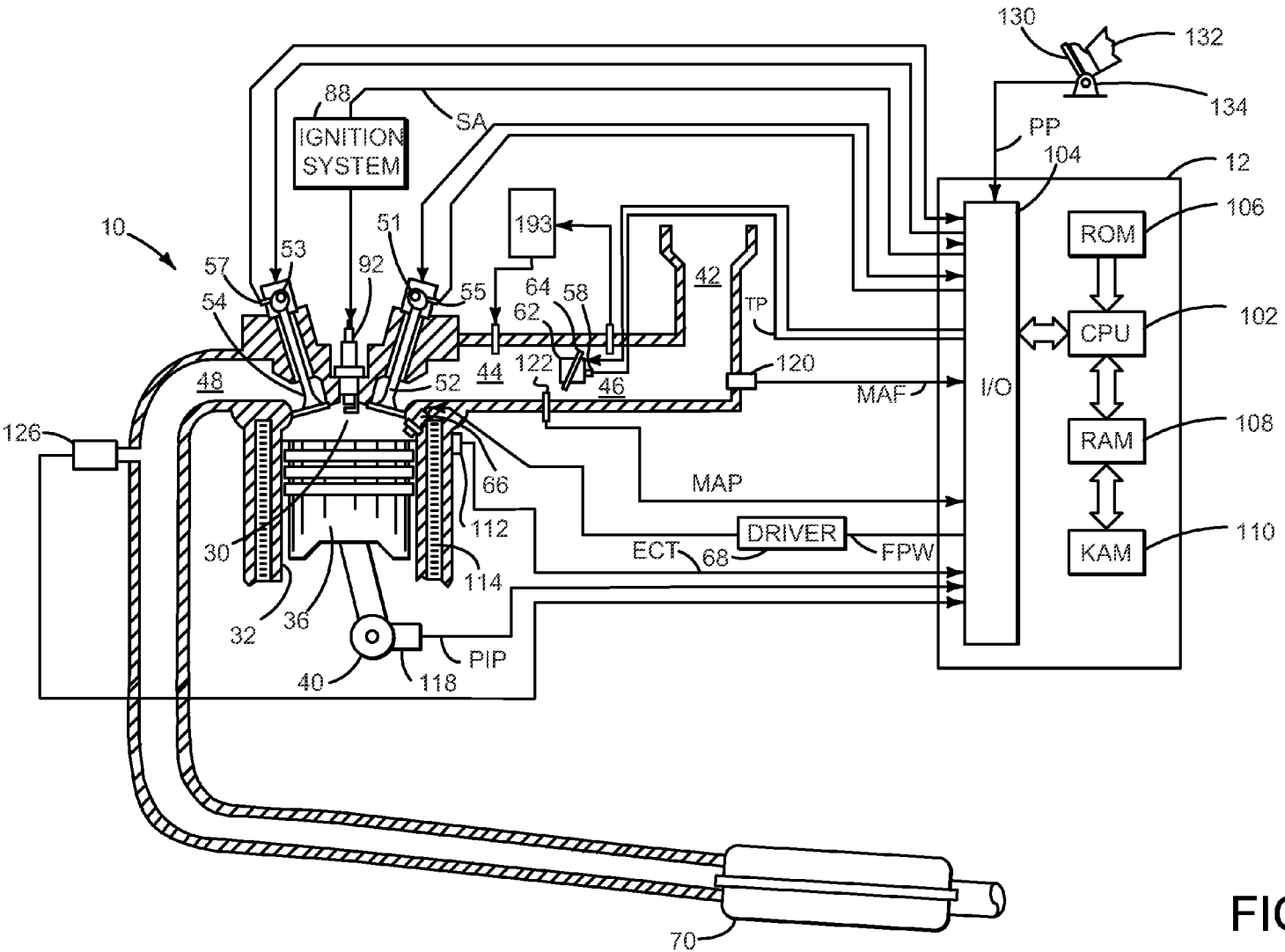
FIG. 1 shows a schematic depiction of one cylinder of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to a crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively or additionally, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46. In other examples, the engine 10 may include a turbocharger having a compressor positioned in the intake system and a turbine positioned in the exhaust system. The turbine may be coupled to the compressor via a shaft. A high pressure, dual stage, fuel system may be used to generate higher fuel pressures at injectors 66.

The intake manifold 44 may receive exhaust gas from a PCV system discussed in greater detail herein with regard to FIGS. 2-5.

Figure 3:
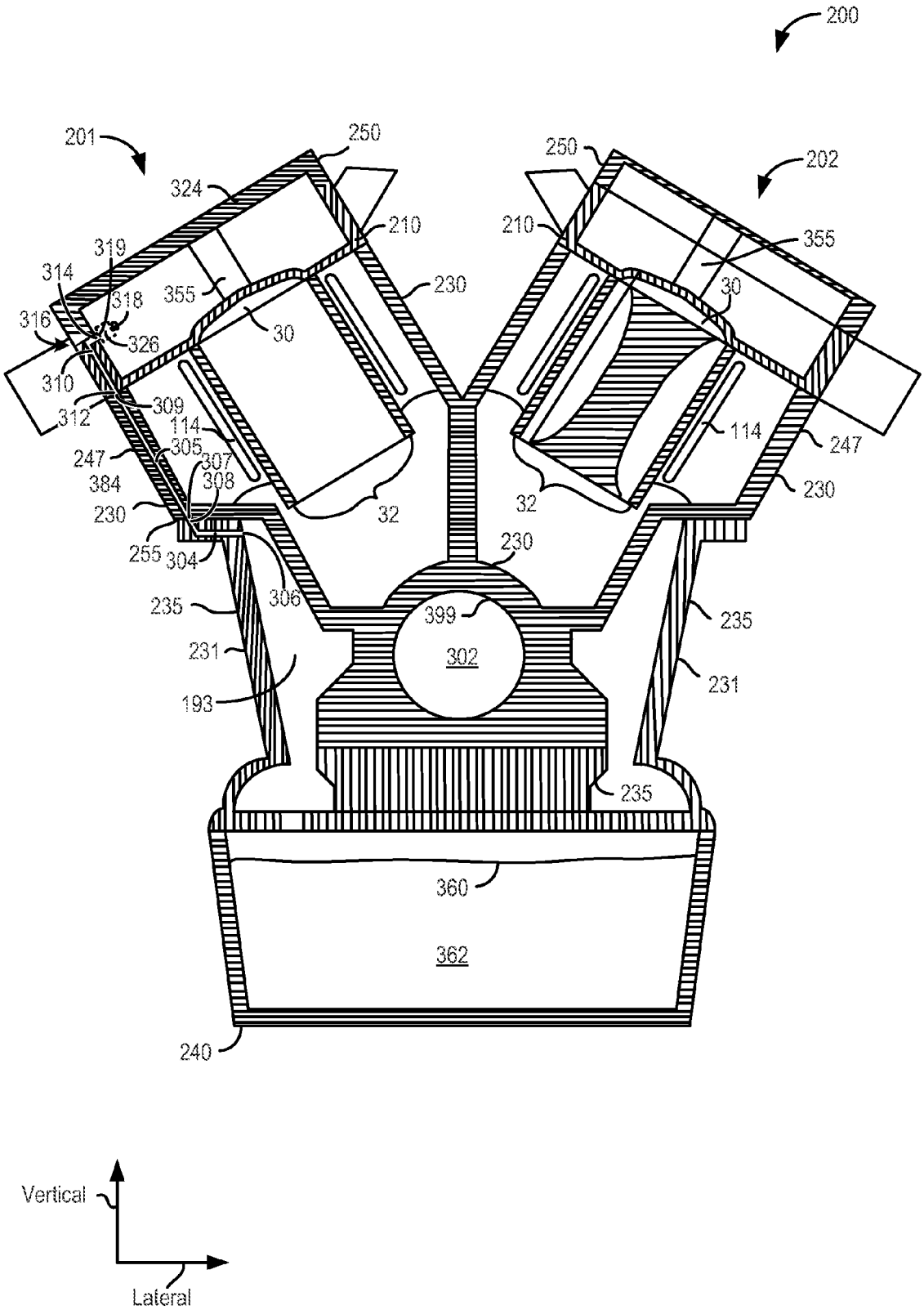
FIG. 3 shows a cut-away section of the V6 engine depicted in FIG. 2.

Engine crankcase 193, shown in more detail in FIG. 3, receives fresh air from the engine intake air system at a location upstream of throttle 62. Moreover, gas from the crankcase may be flowed into the intake system downstream of throttle 62, such as in intake manifold 44. However in some examples, the crankcase 193 may receive air from another suitable location. Thus, the engine crankcase may be ventilated by drawing air from the engine air intake system at a higher pressure location, and returning the air to the engine air intake system at a lower pressure location.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Figure 2:
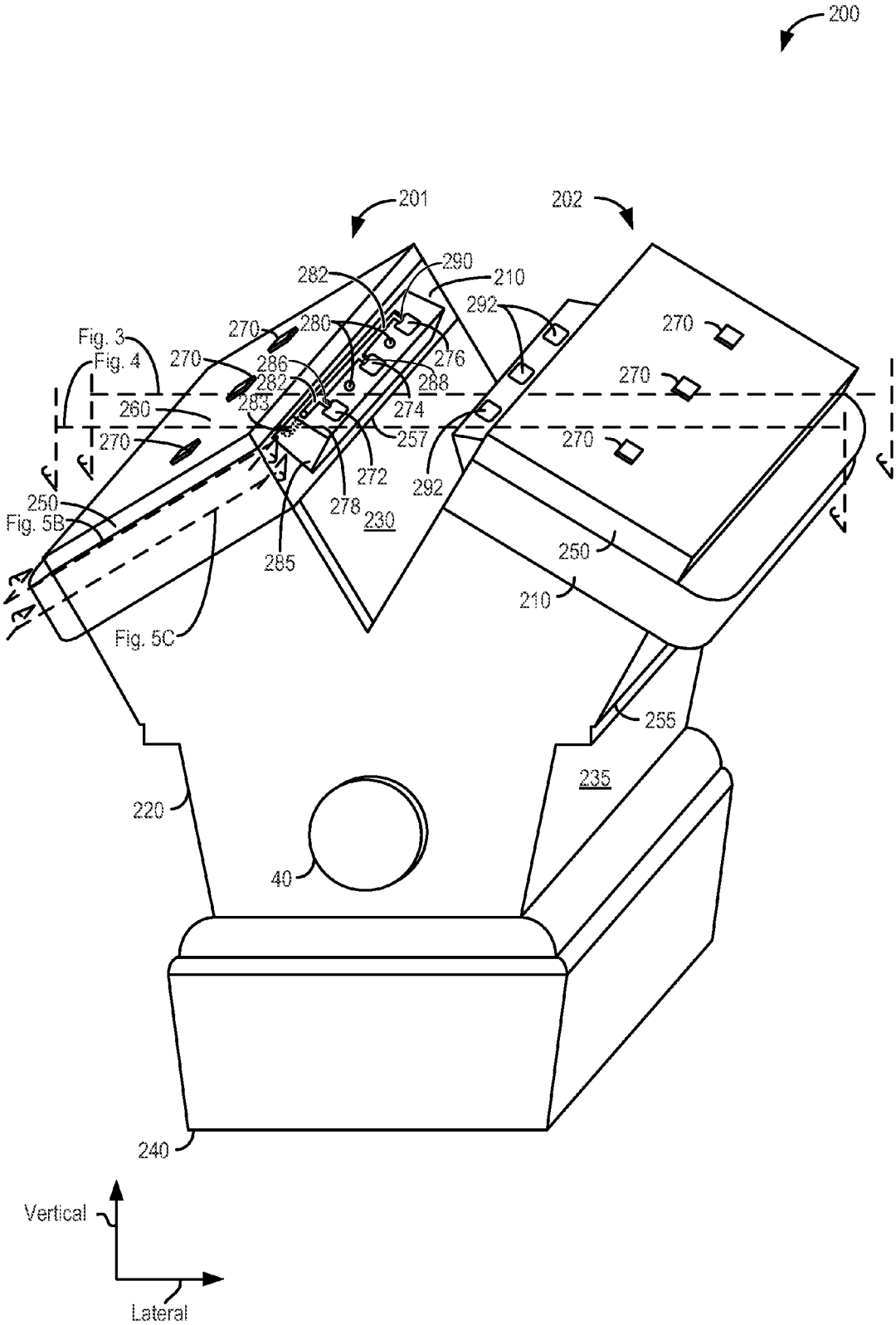
FIG. 2 shows a schematic depiction of a V6 engine.

Referring now to FIG. 2, a schematic depiction of a V6 engine is shown. Engine 200 includes first cylinder bank 201 and second cylinder bank 202. The cylinders banks (201 and 202) may each include half of the engine's 200 cylinders, in some examples. Therefore, the cylinder banks are arranged in a V formation at a non-straight angle with respect to one another. However, in other examples alternate cylinder arrangements are possible. The first and second cylinder banks each house three pistons arranged in a line that provide torque to rotate crankshaft 40. Engine oil pan 240 is coupled to structural frame 235 and holds oil in a sump for lubricating components of engine 200. Engine front cover 220 seals the front of engine 200 from external elements. Structural frame 235 includes sidewalls that extend vertically above the crankshaft 40 so as to provide support for engine cylinder block 230. The exterior sidewalls of engine cylinder block 230 end at a position vertically above crankshaft 40 and extend from a cylinder head engaging surface 257 to a structural frame engaging surface 255.

Figure 5A:
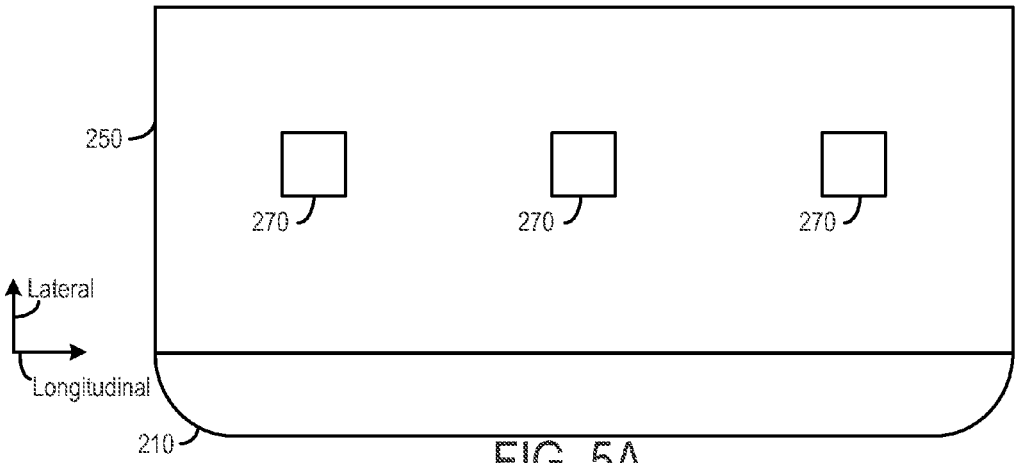
FIGS. 5A-5C show plan views of a cylinder head cover and cylinder head included in the engine shown in FIG. 2.
Figure 5B:
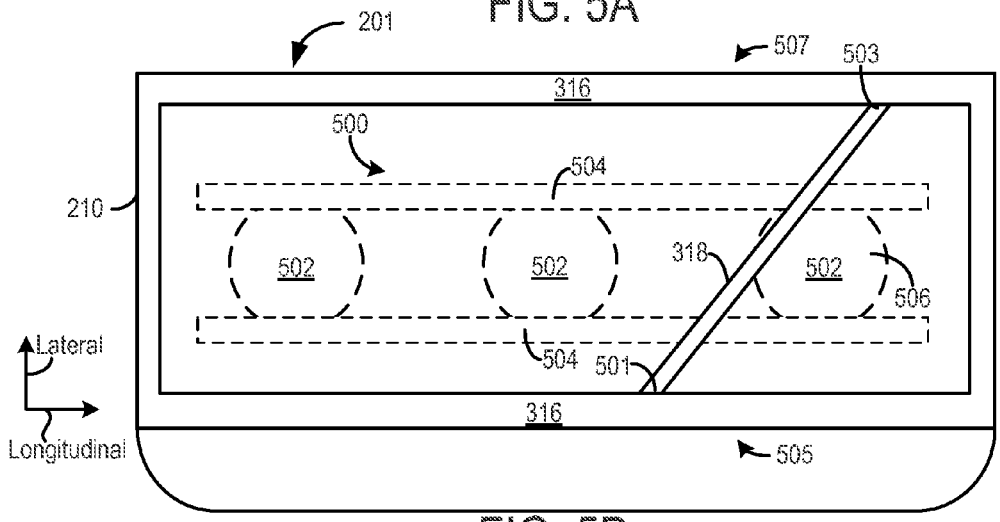
Figure 5C:
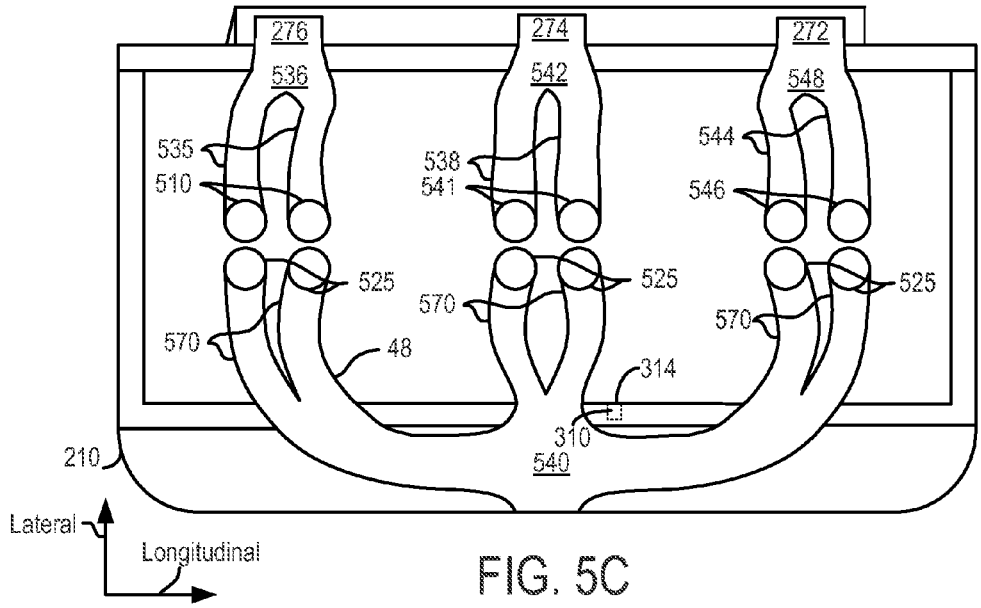

Cylinder heads 210 are coupled to engine cylinder block 230 and include an integrated exhaust manifold 48 shown in FIG. 5C. Cylinder head covers 250 are shown coupled to cylinder heads 210. The cylinder head covers seal the upper portion of engine 200 from external elements and help to keep engine oil within engine 200. The structural frame 235, the cylinder block 230, the cylinder heads 210, the oil pan 240 and/or the cylinder head covers 250 may be included in an engine assembly.

Spark plug coils 270 are pressed into cylinder head covers 250 to provide current to spark plugs (not shown). In the example shown, spark plug coils 270 follow a center line of engine cylinders in first cylinder bank 201 and second cylinder bank 202.

Figure 8:
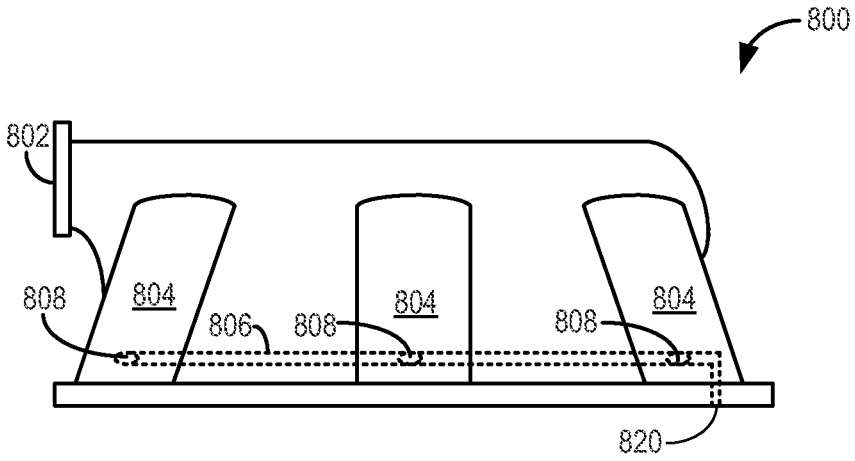
FIGS. 8 and 9 show a depiction of an intake manifold that may be coupled to the engine shown in FIG. 2.
Figure 9:
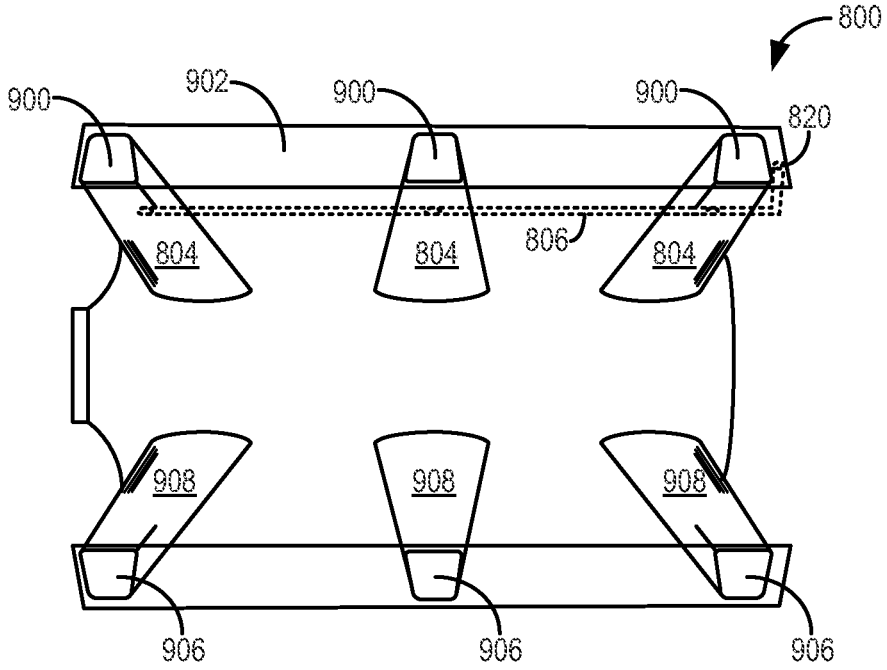

The first cylinder bank 201 further includes a first intake passage 272, a second intake passage 274, and a third intake passage 276. A flange 278 surrounds the intake passages (272, 274, and 276). The flange 278 includes attachment openings 280 configured to attach to an upstream component such as an intake manifold, a compressor, etc. As shown, the flange 278 and intake passages (272, 274, and 276) extend from a wall of the cylinder head 210. An intake manifold may be coupled to the flange 278. An example intake manifold 800 is shown in FIGS. 8 and 9, discussed in greater detail herein.

The engine 200 also includes a PCV system including a flange PCV passage 282 that traverses the flange 278. It will be appreciated that when an upstream component is coupled to the flange 278 the flange PCV passage 282 is substantially sealed. In this way, PCV gas may flow through the flange PCV passage 278 into the intake passages (272, 274, and 276). However, in other examples the flange PCV passage 278 may be sealed without externally coupled components. The flange PCV passage 282 may be constructed via a suitable technique such as milling, casting, etc. The flange PCV passage 278 is in fluidic or pneumatic communication with the crankcase 193, shown in FIG. 3, via a second portion 283 of the cylinder head PCV passage, a cylinder head cover PCV passage 318 shown in FIG. 3, a first portion 310 shown in FIG. 3, and a cylinder block PCV passage 305, and a structural frame PCV passage 304 shown in FIG. 3. The aforementioned passages may be included in the PCV system. In this way, PCV gas may be routed from the crankcase 193 to the intake passage (272, 274, and 276). Therefore, the flange PCV passage 282 supplies crankcase gases to the cylinder bank 201. As shown, the second portion 283 of the cylinder head PCV passages extends into a flange protrusion 285 included in the cylinder head 210. In this way, the PCV gas is internally routed, thereby increasing the compactness of the engine 200 when compared to other engines having externally routed PCV lines.

The flange PCV passage 282 includes a first PCV outlet 286 opening into the first intake passage 272, a second PCV outlet 288 opening into the second intake passage 274, and a third PCV outlet 290 opening into the third intake passage 276. In this way, crankcase gases may be flowed into the intake system of the engine. As a result, emissions from the vehicle are reduced.

Although the first, second, and third PCV outlets (286, 288, and 290) are depicted as having a similar size (e.g., diameter) and geometry it will be appreciated that in other examples, the size (e.g., diameter) and geometry of the outlets (286, 288, and 290) may be altered to alter the flowrate of the gas entering the intake passages. FIG. 2 also shows intake passages 292 included in the second cylinder bank 202.

FIG. 2 also shows cutting planes for the views shown in FIGS. 3, 4, 5B, and 5C. The cutting plane for FIGS. 3 and 4 passes vertically through engine 200. The cutting plane for FIGS. 5B and 5C passes through the cylinder head of first cylinder bank 201.

Referring now to FIG. 3, a cut-away of the V6 engine depicted in FIG. 2 is shown. Engine oil is held in engine oil sump 362 of oil pan 240 and at a level 360. Engine oil pan 240 is coupled to structural frame 235. Structural frame 235 includes two exterior sidewalls 231 that form a portion of the engine sidewall. The exterior sidewalls 231 of structural frame 235 extend above the center of crankshaft bore 302. Structural frame 235 also extends across the engine so as to link or couple the exterior sidewalls 247 of engine cylinder block 230. Further, structural frame 235 is coupled to the exterior sidewalls 247 of engine cylinder block 230. Structural frame 235 may also be coupled to crankshaft support 399.

Engine cylinder block 230 includes cylinder walls 32 and engine cylinder block 230 extends from a cylinder head engaging surface 257 to structural frame engaging surface 255. Engine cylinder block 230 also includes crankshaft supports 399 and cooling sleeve 114.

Cylinder heads 210 are coupled to engine cylinder block 230 and include a top portion of combustion chamber 30. Cylinder heads 210 also include exhaust manifold 48 shown in greater detail in FIG. 5C. Spark plug service ports 355 provide access to spark plugs (not shown). Cylinder head cover 250 is shown coupled to cylinder head 210.

A crankcase 193 is also shown. The crankshaft, bearing caps, journal bearings, and journals may be positioned in the crankcase 193. It will be appreciated, that the crankcase 193 is substantially sealed. Moreover, the crankcase 193 receives blow-by gases from the cylinders in the first cylinder bank 201 and the second cylinder bank 202 during operation of the engine.

A structural frame PCV passage 304 extending through a portion of the structural frame 235 including an inlet 306 opening into the crankcase 193 is included in the PCV system. In this way, gas may be received by the structural frame PCV passage 304. The structural frame PCV passage 304 also includes an outlet 308. The structural frame PCV passage 304 is in fluidic or pneumatic communication with a cylinder block PCV passage 305 and includes an inlet 307 and an outlet 309. The cylinder block PCV passage 305 traverses an outer wall of the cylinder block 230. In other examples, the structural frame PCV passage 304 may not be included in the engine assembly, therefore the cylinder block PCV passage 305 may open into the crankcase 193 in such an embodiment. The cylinder block PCV passage 305 is in fluidic or pneumatic communication with a first portion 310 of a cylinder head PCV passage. The first portion 310 of the cylinder head PCV passage includes an inlet 312 and an outlet 314. The first portion 310 of the cylinder head PCV passage extends from a bottom of a cylinder head (e.g., structural frame engaging surfaced 255) to a cylinder head cover engaging surface 316.

Additionally, the first portion 310 of the cylinder head PCV passage is in fluidic communication with cylinder head cover PCV passage 318. The cylinder head cover PCV passage 318 may extend through an enclosure partially defined by the cylinder head cover 250, as discussed in greater detail herein. However in other examples, the cylinder head cover PCV passage 318 may extend through an upper wall 324 of the cylinder head cover 250. The cylinder head cover PCV passage 318 is in fluidic communication with a second portion 283 of the cylinder head PCV passage including an inlet 403 and an outlet 405, shown in FIG. 4. Furthermore, the cylinder head cover PCV passage 318 includes an inlet 319 and an outlet 321, shown in FIG. 4.

An oil separator 326 may be coupled to the cylinder head cover PCV passage 318, in some examples. The oil separator 326 may be configured to remove oil from the gas flowing through the cylinder head cover PCV passage 318. The cylinder head cover PCV passage 318 is in fluidic communication with the flange PCV passage 282, shown in FIG. 2, via the PCV passage 328, shown in greater detail in FIG. 5B.

Figure 4:
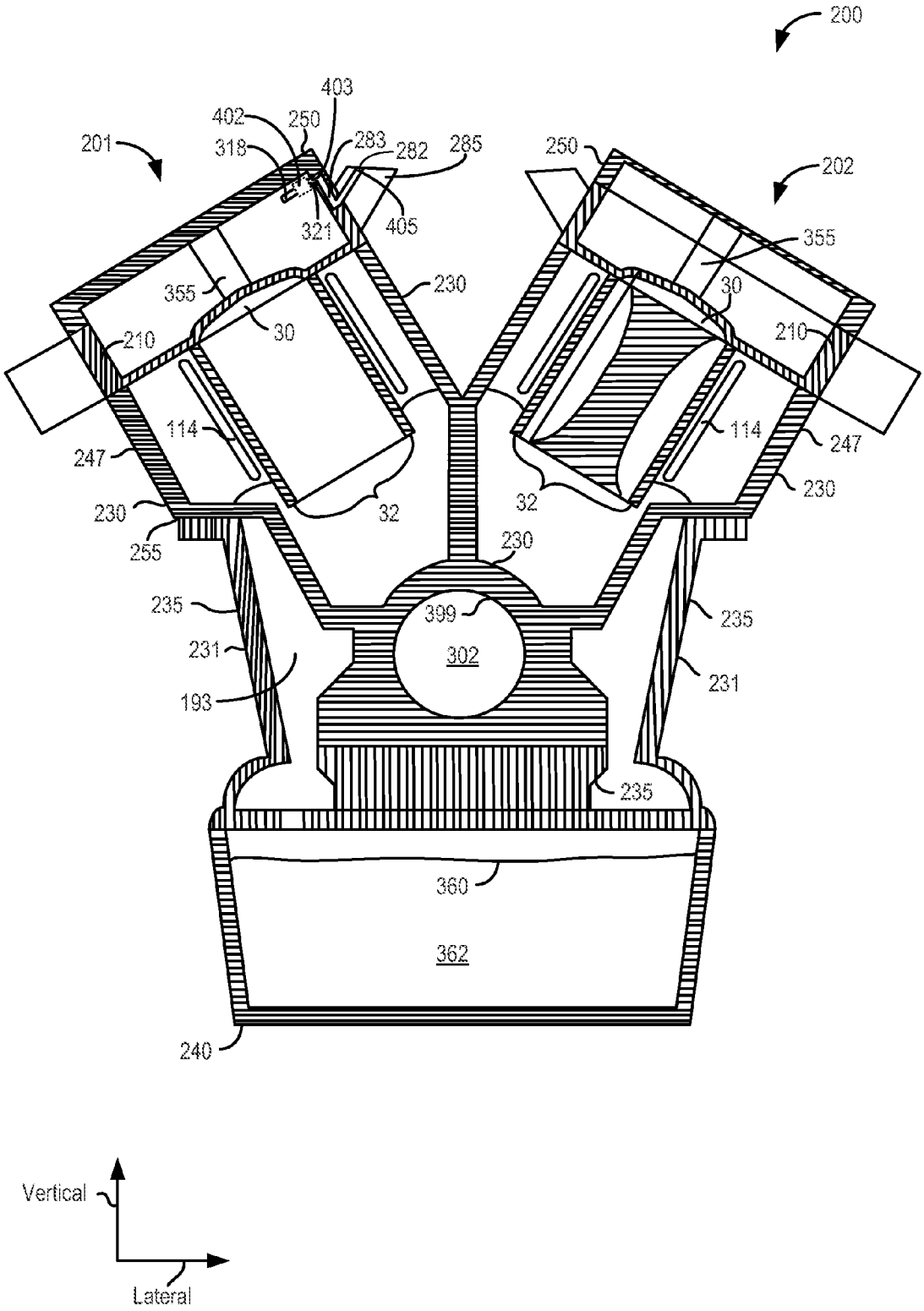
FIG. 4 shows another cut-away section of the V6 engine depicted in FIG. 2.

FIG. 4 shows another cross-section of the engine depicted in FIG. 2. FIG. 4 shows, the cylinder head cover PCV passage 318 in fluidic communication with the second portion 283 of the cylinder head PCV passage. The second portion 283 of the cylinder head PCV passage is in fluidic communication with the flange PCV passage 282. Furthermore, the second portion 283 of the cylinder head PCV passage includes an inlet 403 in fluidic communication with the cylinder head cover PCV passage 318 and an outlet 405 fluidly coupled to the flange PCV passage 282. A valve 402 may be coupled to cylinder head cover PCV passage 318. The valve 402 may be controlled via controller 12, shown in FIG. 1, and may be configured to alter the flowrate of the gas flowing into the flange PCV passage 282. In this way, the PCV gas flowing into the engine's intake system can be metered.

Referring now to FIG. 5A, a plan view of cylinder head 210 and cylinder head cover 250 is shown. Spark plug coils 270 are arranged in a line following a center line of a bank of engine cylinders.

Referring now to FIG. 5B, a cut-away plan view of cylinder head 210 is shown. As shown the cylinder head cover PCV passage 318 extending through an enclosure 500 whose boundary is partially defined by the cylinder head cover 250 shown, in FIG. 5A. The cylinder head cover PCV passage 318 includes an inlet 501 on the cylinder head cover engaging surface 316 and an outlet 503 on the cylinder head cover engaging surface 316. The inlet 501 is adjacent to the exhaust manifold 48 shown in FIG. 5C in the depicted embodiment. The cylinder head cover PCV passage 318 laterally and longitudinally traverses the enclosure. Specifically, the cylinder head cover PCV passage 318 extends from an intake side 505 of the enclosure 500 to an exhaust side 507 of the enclosure 500. Therefore, the cylinder head cover PCV passage 318 spans the enclosure 500 from an intake side 505 of the enclosure 500 to an exhaust side 507 of the enclosure 500. The sides of the enclosure 500 may be partially defined by the external walls of the cylinder head. The top of the enclosure 500 may be defined by the cylinder head cover 250, shown in FIG. 5A. However, other arrangements may be used in other examples. The cylinders 502 in the cylinder bank 201 and the camshafts 504 are also depicted. As shown, the cylinder head cover PCV passage 318 extends over both of the camshafts 504. It will be appreciated that the camshafts may be configured to cyclically actuate cylinder valves. Moreover, the cylinder head cover PCV passage 318 traverses a portion of the enclosure above a peripheral cylinder 506.

Referring now to FIG. 5C, another cut-away plan view of cylinder head 210 is shown. Cylinder head 210 includes exhaust manifold 48 which is comprised of exhaust runners 570 and confluence area 540. Exhaust gases exit engine cylinders at exhaust ports 525 and enter exhaust runners 570. Cylinder head 210 also includes a first set of intake runners 535 each in fluidic communication with an intake valve of a cylinder via intake ports 510. The intake runners 535 converge at confluence area 536 which is in fluidic communication with intake passage 276. The cylinder head 210 also includes a second set of intake runners 538 each in fluidic communication with an intake valve of a cylinder via intake ports 541. The intake runners 538 converge at confluence area 542 which is in fluidic communication with the intake passage 274. The cylinder head 210 also includes a third set of intake runners 544 each in fluidic or pneumatic communication with an intake valve of a cylinder via intake ports 546. The intake runners 544 converge at confluence area 548 which is in fluidic communication with intake passage 272.

The outlet 314 first portion 310 of the cylinder head PCV passage is also shown in FIG. 5C. The cylinder head PCV passage is adjacent to the confluence 540 of the exhaust manifold 48. Therefore, a portion of the cylinder head cover PCV passage 318 is also adjacent to the exhaust manifold 540.

Referring now to FIG. 600, a flowchart of an example method 600 for operating a PCV system. Method 600 may be used to operate the PCV system discussed above with regard to FIGS. 1-5 or another suitable PCV system.

At 602, the method includes flowing gas from a sealed crankcase to a cylinder block PCV passage traversing an outer wall of a cylinder block. Next at 604 the method includes flowing gas from the cylinder block PCV passage to a cylinder head PCV passage extending through the cylinder head to a cylinder head cover engaging surface.

Next at 606, the method includes flowing gas from the cylinder head PCV passage through a cylinder head cover PCV passage traversing an enclosure having a boundary partially defined by a cylinder head cover coupled to the cylinder head cover engaging surface.

At 608, the method includes flowing gas from the cylinder head cover PCV passage to a flange PCV passage traversing a flange enclosing an intake passage. Next at 610, the method includes flowing gas from the flange PCV passage to the intake passage. At 612, the method includes flowing gas from the intake passage to a cylinder.

Figure 6:
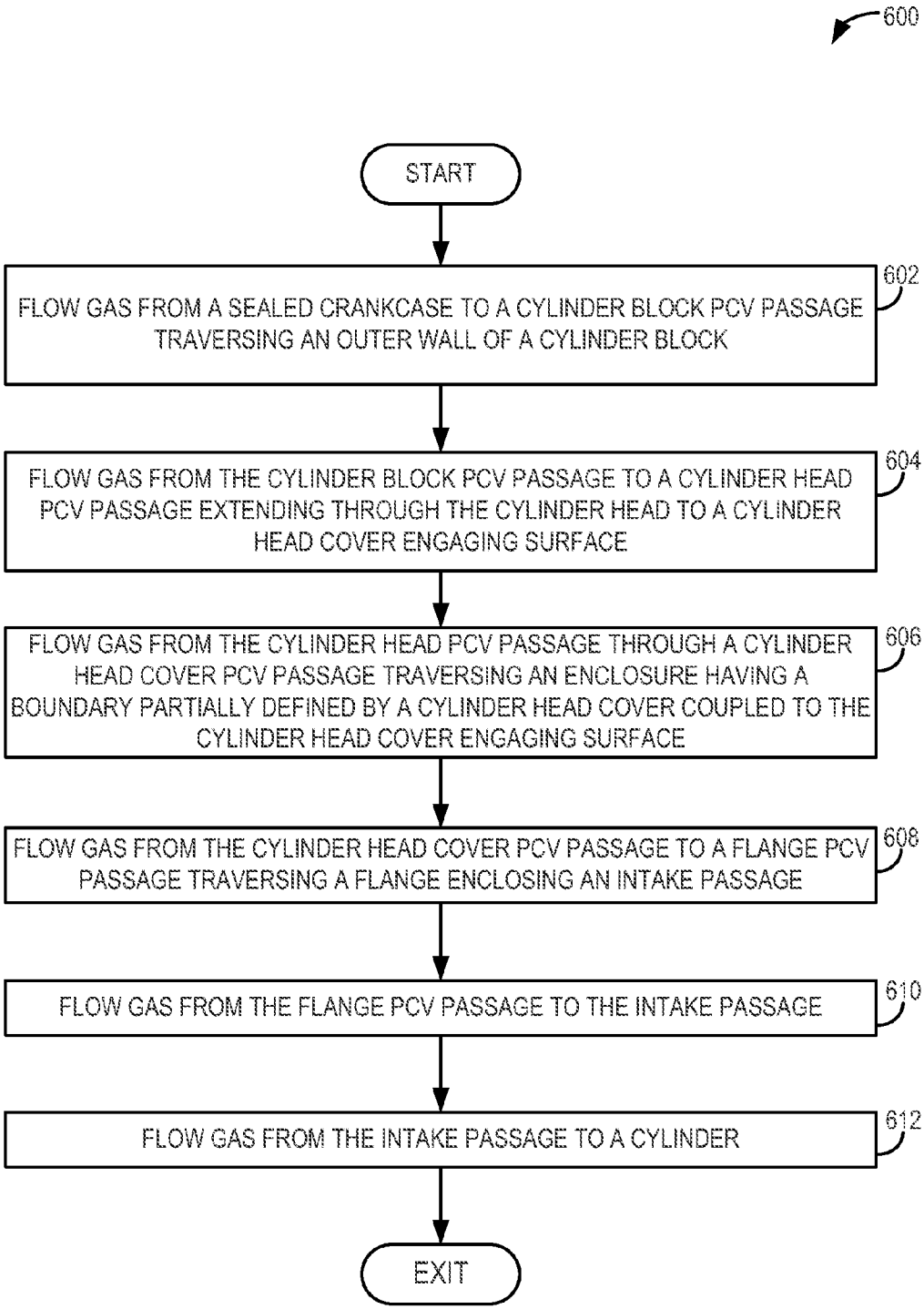
FIG. 6 shows a flowchart of an example method for operating a PCV system.

Thus, the method of FIG. 6 provides for a method for operation of a PCV system comprising flowing gas from a sealed crankcase to a cylinder block PCV passage traversing an outer wall of a cylinder block, flowing gas from the cylinder block PCV passage to a cylinder head PCV passage extending through a cylinder head to a cylinder head cover engaging surface, and flowing gas from the cylinder head PCV passage to a flange PCV passage, the flange PCV passage traversing a flange enclosing an engine air intake passage, and flowing gas from the flange PCV passage to the intake passage.

The method shown in FIG. 6 also provides for a method where flowing gas from the cylinder head PCV passage to a flange PCV passage traversing a flange enclosing an intake passage includes flowing gas from the cylinder head PCV passage through a cylinder head cover PCV passage traversing an enclosure having a boundary partially defined by a cylinder head cover coupled to the cylinder head cover engaging surface and flowing gas from the cylinder head cover PCV passage to the flange PCV passage. The method shown in FIG. 6 may also provides for a method further comprising flowing gas from the flange PCV passage to a second intake passage.

Figure 7:
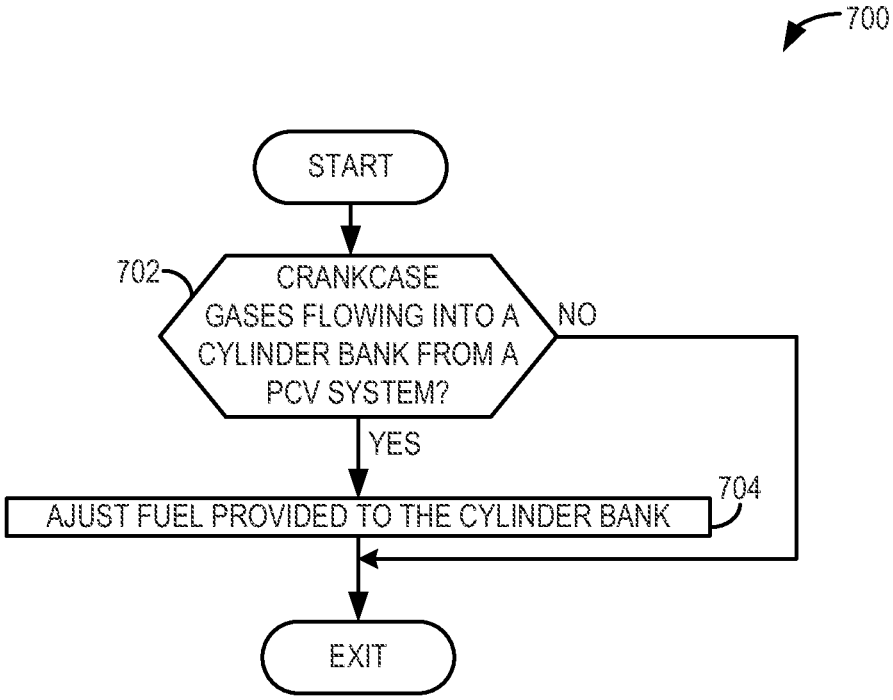
FIG. 7 shows a flowchart of an example method for operation of an engine.

FIG. 7 shows a method 700 for operation of an engine. It will be appreciated that the method may be used to operate the engines described above with regard to FIGS. 1-5 or may be used to operate other suitable engines.

At 702, the method determines if crankcase gases are flowing into a cylinder bank from a PCV system. It will be appreciated that the PCV system may include a plurality of PCV passages providing fluidic communication between a crankcase of the engine assembly and a cylinder intake port of the engine assembly without hoses or conduits external to the engine assembly. Furthermore, it will be appreciated that the cylinder bank may contain half of the cylinders in the engine.

If it is determined that crankcase gases are not flowing into the cylinder bank (NO at 702) the method ends. However, if it is determined that crankcase gases are flowing into the cylinder bank (YES at 702) the method proceeds to 704 where the fuel provided to the cylinder bank is adjusted responsive to the determination at 702. In this way, the air fuel-ratio in the cylinder bank may be adjusted based on the gases flowing through the PCV system.

Thus, the method of FIG. 7 provides for a method comprising adjusting fuel to half the number of cylinders in response to gases flowing through the PCV system.

As will be appreciated by one of ordinary skill in the art, the method described in FIGS. 6 and 7 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

FIG. 8 shows a side view of an intake manifold 800 that may be coupled to the flange 278 shown in FIG. 2. The intake manifold 800 includes an inlet 802 configured to receive intake air. Additionally, the inlet 802 is in fluidic communication with the intake passages 272, 274, and 276, shown in FIG. 2, via runners 804. In other examples, inlet 802 may be in fluidic communication with all cylinder ports. In this way, intake air and PCV gases can be directed into the engine via the intake manifold 800. A manifold PCV passage 806 extends through the intake manifold 800 and includes one or more outlets 808 opening into the runners 804. In this way, crankcase gases may be flowed into the intake manifold 800 from the manifold PCV passage 806. The manifold PCV passage 806 may be in fluidic communication with the second portion 283 of the cylinder head PCV passage, shown in FIG. 2. A PCV port 820 is also shown. The PCV port 820 may be in fluidic communication with the outlet 405, shown in FIG. 4, of the second portion 283 of the cylinder head PCV passage. In this way, crankcase gases can be internally routed through the cylinder head 210, shown in FIG. 2, to the intake manifold 800. In such an embodiment, the flange PCV passage 282, shown in FIG. 2, may not be included in the engine 200.

FIG. 9 shows a bottom view of the intake manifold 800. The intake manifold 800 includes outlets 900 of the runners 804 fluidly coupled to the intake passages (272, 274, and 276) shown in FIG. 2. Furthermore, the intake manifold 800 includes a flange 902 which may be coupled to and in face sharing contact with the flange 278 shown in FIG. 2. The PCV port 820 is also shown. The intake manifold also includes outlets 906 of runners 908 in fluidic communication with the intake passages 292, shown in FIG. 2.

Thus, the system illustrated in FIGS. 1-5 and 8-9 provides for a PCV system, comprising an engine assembly, the engine assembly including an engine block, a cylinder head, a valve cover, and an intake manifold and a plurality of PCV passages providing fluidic communication between a crankcase of the engine assembly and a cylinder intake port of the engine assembly without hoses or conduits external to the engine assembly.

The system shown in FIGS. 1-5 and 8-9 also provides for a PCV system where the plurality of PCV passages includes a PCV outlet within the intake manifold. The system shown in FIGS. 1-5 and 8-9 also provides for a PCV system where the plurality of PCV passages includes a PCV outlet within the cylinder head. The system shown in FIGS. 1-5 and 8-9 also provides for a PCV system where the plurality of PCV passages extends through at least a portion of the engine block, cylinder head, and valve cover. The system shown in FIGS. 1-5 and 8-9 also provides for a PCV system where the engine assembly includes a number of cylinders and where fuel is adjusted to half the number of cylinders in response to gases flowing through the PCV system.

The system shown in FIGS. 1-5 and 8-9 also provides for a PCV system a PCV system, comprising a cylinder head including a cylinder head PCV passage that extends from a bottom of a cylinder head to a cylinder head cover engaging surface, the cylinder head also including a flange PCV passage and a cylinder head cover including a cylinder head cover PCV passage, the cylinder head cover coupled to the cylinder head cover engaging surface, the cylinder head cover PCV passage in fluidic communication with the cylinder head PCV passage and the flange PCV passage.

The system shown in FIGS. 1-5 and 8-9 also provides for a PCV system where the flange PCV passage is in communication with an engine cylinder. The system shown in FIGS. 1-5 and 8-9 also provides for a PCV system where the cylinder head cover defines a boundary of an enclosure and the cylinder head cover PCV passage spans the enclosure from an intake side to an exhaust side. The system shown in FIGS. 1-5 and 8-9 also provides for a PCV system where the cylinder head cover PCV passage traverses the cylinder head cover. The system shown in FIGS. 1-5 and 8-9 also provides for a PCV system where the flange PCV passage supplies crankcase gases to half a number of cylinders in the cylinder head. The system shown in FIGS. 1-5 and 8-9 also provides for a PCV system where the cylinder head PCV passage, the cylinder head cover PCV passage, and the flange PCV passage are coupled in a series flow configuration.

The system shown in FIGS. 1-5 and 8-9 also provides for a PCV system further comprising an oil separator located along the cylinder head cover PCV passage. The system shown in FIGS. 1-5 and 8-9 also provides for a PCV system where the flange PCV passage is in fluidic communication with an intake passage. The system shown in FIGS. 1-5 and 8-9 also provides for a PCV system where a first PCV outlet of the flange PCV passage opens into the first intake passage and a second PCV outlet of the flange PCV passage opens into the second intake passage, the second PCV outlet having a similar size and geometry as the first PCV outlet. The system shown in FIGS. 1-5 and 8-9 also provides for a PCV system where the flange PCV passage is in fluidic communication with a second intake passage and the first and second intake passages are fluidly coupled to separate cylinders in a cylinder bank.

The system shown in FIGS. 1-5 and 8-9 also provides for a PCV system where the intake passage is in fluidic communication with at least two runners fluidly coupled to a cylinder. The system shown in FIGS. 1-5 and 8-9 also provides for a PCV system further comprising a valve coupled to the PCV passage configured to alter the flowrate of the gas into an intake passage.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A positive crankcase ventilation (PCV) system, comprising:

a cylinder head including a cylinder head PCV passage that extends from a bottom of the cylinder head to a cylinder head cover engaging surface, the cylinder head also including a flange PCV passage; and a cylinder head cover including a cylinder head cover PCV passage, the cylinder head cover coupled to the cylinder head cover engaging surface, the cylinder head cover PCV passage in fluidic communication with the cylinder head PCV passage and the flange PCV passage;

wherein the PCV passages provide fluidic communication between a crankcase of an engine assembly and a cylinder intake port of the engine assembly without hoses or conduits external to the engine assembly, the engine assembly including an engine block, the cylinder head, and the cylinder head cover, and where the flange PCV passage is in communication with an engine cylinder.

2. The PCV system of claim 1, where the cylinder head cover defines a boundary of an enclosure and the cylinder head cover PCV passage spans the enclosure from an intake side to an exhaust side.

3. The PCV system of claim 1, where the cylinder head cover PCV passage traverses the cylinder head cover.

4. The PCV system of claim 1, where the flange PCV passage supplies crankcase gases to half a number of cylinders in the cylinder head.

5. The PCV system of claim 1, where the cylinder head PCV passage, the cylinder head cover PCV passage, and the flange PCV passage are coupled in a series flow configuration.

6. The PCV system of claim 1, further comprising an oil separator located along the cylinder head cover PCV passage.

7. The PCV system of claim 1, where the flange PCV passage is in fluidic communication with an intake passage.

8. The PCV system of claim 7, where a first PCV outlet of the flange PCV passage opens into a first intake passage and a second PCV outlet of the flange PCV passage opens into a second intake passage, the second PCV outlet having a similar size and geometry as the first PCV outlet.

9. The PCV system of claim 8, where the flange PCV passage is in fluidic communication with the second intake passage and the first intake passage and second intake passage are fluidly coupled to separate cylinders in a cylinder bank.

10. The PCV system of claim 7, where the intake passage is in fluidic communication with at least two runners fluidly coupled to a cylinder.

11. The PCV system of claim 1, further comprising a valve coupled to the cylinder head cover PCV passage configured to alter a flow rate of gas into an intake passage.

12. A method for operation of a PCV system comprising:

flowing gas from a sealed crankcase to a cylinder block PCV passage traversing an outer wall of a cylinder block;

flowing gas from the cylinder block PCV passage to a cylinder head PCV passage extending through a cylinder head to a cylinder head cover engaging surface; and flowing gas from the cylinder head PCV passage to a flange PCV passage, the flange PCV passage traversing a flange enclosing an engine air intake passage; and flowing gas from the flange PCV passage to the intake passage without the use of hoses or conduits external to an engine assembly.

13. The method of claim 12, where flowing gas from the cylinder head PCV passage to the flange PCV passage traversing the flange enclosing the intake passage includes:

flowing gas from the cylinder head PCV passage through a cylinder head cover PCV passage having a boundary partially defined by a cylinder head cover coupled to the cylinder head cover engaging surface; and flowing gas from the cylinder head cover PCV passage to the flange PCV passage.

14. The method of claim 12, further comprising flowing gas from the flange PCV passage to a second intake passage.

* * * * *